United States Patent [19]

Sackett

[11] Patent Number: 4,701,751

[45] Date of Patent: Oct. 20, 1987

[54] POOL ALARM SYSTEM

[76] Inventor: Robert L. Sackett, 2282 #43 Caminito Pescado, San Diego, Calif. 92107

[21] Appl. No.: 894,899

[22] Filed: Aug. 8, 1986

Related U.S. Application Data

[62] Division of Ser. No. 669,896, Nov. 9, 1984, Pat. No. 4,620,181.

[51] Int. Cl.[4] ..... G08B 13/18

[52] U.S. Cl. ..... 340/556; 340/573; 250/221

[58] Field of Search ..... 340/539, 573, 556, 555; 250/227, 221; 377/6; 235/33, 44

[56] References Cited

U.S. PATENT DOCUMENTS

| | | | |
|---|---|---|---|
| 3,163,856 | 12/1964 | Kirby | 340/539 X |
| 3,207,266 | 9/1965 | Hornung | 250/221 X |
| 3,716,833 | 2/1973 | Roth | 340/556 |
| 3,786,406 | 1/1974 | Bianco | 340/573 X |
| 3,810,146 | 5/1974 | Lieb | 340/573 X |
| 4,121,200 | 10/1978 | Colmenero | 340/566 |
| 4,305,143 | 12/1981 | Simms et al. | 340/573 X |
| 4,355,238 | 10/1982 | Ruell | 250/577 |
| 4,450,722 | 5/1984 | Keyes, IV et al. | 340/619 X |
| 4,549,169 | 10/1985 | Moura et al. | 340/573 X |

*Primary Examiner*—James L. Rowland
*Assistant Examiner*—Jeffery A. Hofsass
*Attorney, Agent, or Firm*—Frank D. Gilliam

[57] ABSTRACT

An alarm system for a swimming pool or the like whereby small inexperienced children or animals are detected prior to entering the pool or after an unauthorized entry into the water of the pool. The invention comprises the use of a height sensing apparatus employing fibre optics and a logic circuit whereby an interruption of a pair of different elevations of light paths is accepted and the alarm remains silent and the interruption of the lowest light path only is reflected sounding an alarm. The invention further comprises the use of fibre optics and a movement sensor connected to the optics. Any impact on the water surface of the pool causes the sensor to change the state of the light transmission therethrough by transmitting or interrupting light transmission. This change of normal state activates the alarm. The invention still further comprises a wireless means for detecting a person in the pool water or a man overboard from a ship or the like and sounding an alarm.

3 Claims, 10 Drawing Figures

POOL ALARM SYSTEM

This is a division, of application Ser. No. 669,896, filed Nov. 9, 1984, now U.S. Pat. No. 4,620,181.

BACKGROUND OF THE INVENTION

The invention relates to a device or devices for sensing specified conditions in and out of fluid and has particular application as a swimming pool alert alarm for sensing persons or animals in or around the swimming pool as well as sensing a man overboard.

There are a number of sensing devices for this purpose available at least in the prior art. Some of these devices are as follows:

U.S. Pat. No. 3,054,096 awarded to S. Peritz teaches an emergency alarm particularly adaptable for use in a swimming pool. The device is adapted to float on the surface of the water and includes a pendulum which activates an audio alarm when sufficient water motion moves the pendulum to complete the alarm energizing circuit connected thereto. This device has certain drawbacks, namely, it is wind activated as well as by objects falling into the pool water and is an obstruction to authorized users of the swimming pool. If the device were adjusted whereby all but strong wind gusts were not detected then small children or animals would most probably not be detected either. The electrical circuit could be exposed to water rendering the device inoperable.

U.S. Pat. No. 3,475,746, awarded to inventors L. H. Nelson et al., teaches a self contained device that floats freely on the surface of a pool or the like. When the liquid in the pool is disturbed, a flexible diaphragm responds to pneumatic pressure producing a chamber containing air by wave motion to actuate a signaling device which continues to operate until turned off. This teaching encounters the same problems as the Peritz Patent discussed above.

U.S. Pat. No. 3,486,166, awarded to inventors N. L. Campana et al., teaches an alarm system for swimming pools which operates by submerging the sensing means (hydrophone) into the pool water. This system could only be installed at great economic expense to the pool owner and could not be removed from the pool for use elsewhere, etc.

U.S. Pat. No. 3,808,887, awarded to Albert T. Buttress, teaches the use of fibre optics to monitor liquid levels in a light transparent tank. This reference does not teach the use of fibre optics submerged in a liquid for measuring surface impact of that liquid.

U.S. Pat. No. 4,187,502, awarded to Frank O. Beverly et al., teaches a swimming pool alarm with a pressure transducer immersed into the swimming pool water. This system is expensive to produce, places the electronics in a position susceptible to water damage and could be triggered by external noise.

U.S. Pat. No. 4,408,193, awarded to Theodore I. Millen, teaches a swimming pool alarm system which monitors wave motion. This system has the obvious wind generated wave problems discussed above.

There has not been a completely successful swimming pool alarm system until the emergence of this invention.

SUMMARY OF THE INVENTION

The invention is directed to a swimming pool alarm system which is operable under even adverse weather and noise conditions and locates all of the electronic components remote from the pool water. The alarm system employs a sensing means comprised of a pair of diaphragms secured to a base member. Input and output fibre optics light transmission means are attached to the sensing means whereby when the surface of the pool water is impacted by an object light is either transmitted out the output fibre optic transmission to the sensing means or is interrupted whereby no light reaches the sensing means depending on the state of the optics under the normal pool non-impacted state. A switching means responsive to the new state of the light transmitting means activates an external alarm, audio, visual or the like. The alarm continues to be energized until manually deactivated.

An additional feature allows a person or animal to carry a sensor means on their person, whereby when the sensor impacts the water the alarm is sounded. Obviously this feature could be used on a boat for a man overboard situation.

The invention further includes a pool area entry sensing device which allows normal height adults or the like non-alarm entry into the pool area while sounding the alarm when small children or animals enter the same pool area. The system is adjustable to vary the selected heights of non-alarm and alarm entry into the pool area.

An object of this invention is to provide a swimming pool alarm system which is non responsive to the elements or environments.

Another object of this invention is to provide a swimming pool alarm system having only non-electrical components located in or near the pool water.

Another object of this invention is to provide a sensor carried by a person or animal likely to have unauthorized access to a swimming pool or a person subjected to falling into the water from a boat or the like.

Still another object of the invention is to provide a system for warning of the access to a pool area by an unauthorized person or animal and provide no warning when authorized persons enter the same pool area.

These and other objects, features and advantages of the present invention, will be further appreciated as the detailed description is read in conjunction with the drawings.

DETAILED DESCRIPTION OF THE PREFERRED EMBODIMENTS

Figure 1:
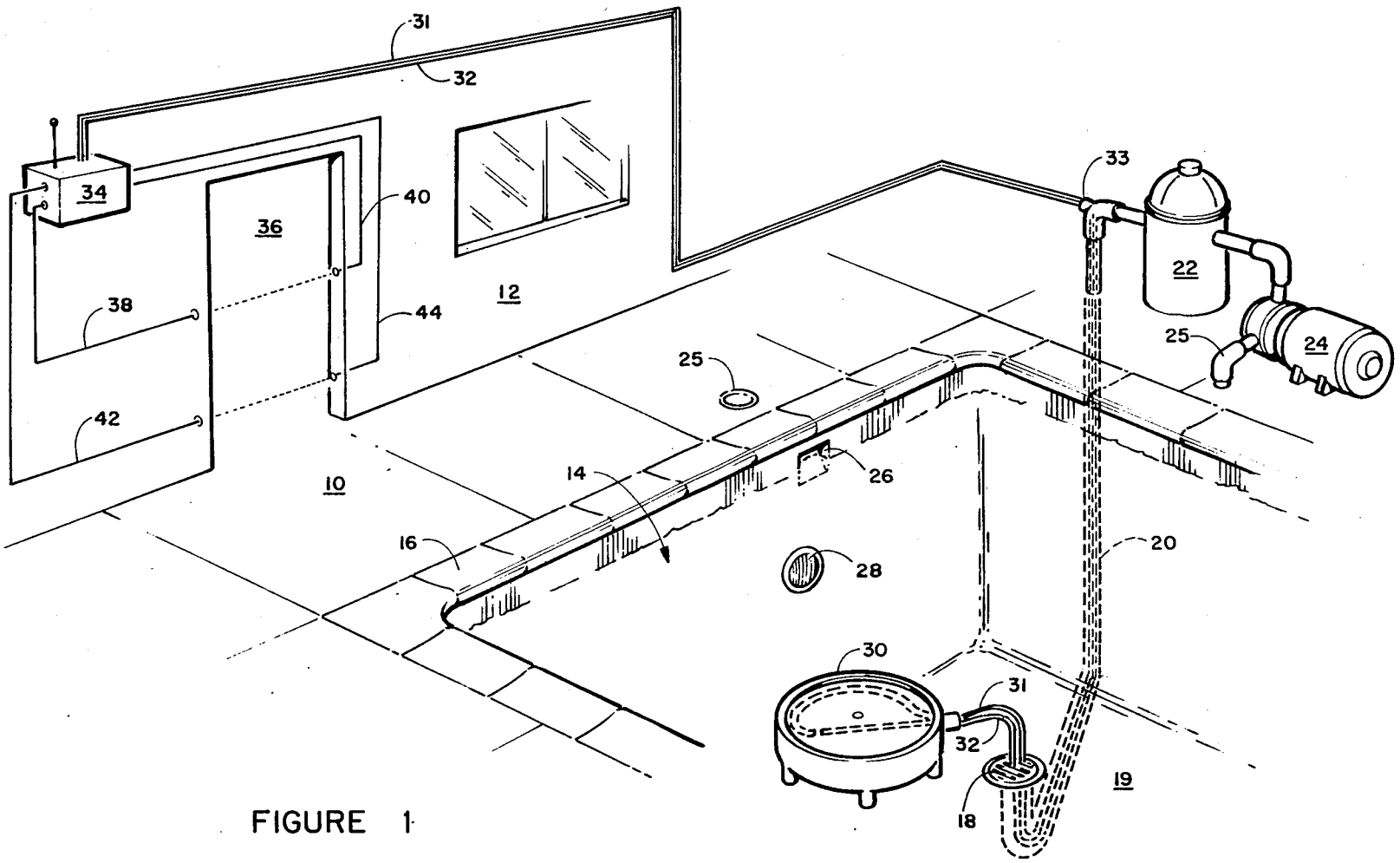
FIG. 1 is a perspective partially cut-away showing of the invention in a use environment.

Referring now to FIG. 1, in which a typical home swimming pool environment is shown with the instant invention employed. A deck area 10 separates a wall 12 from the swimming pool 14. The pool is shown having a rim 16, a normal water circulating system including an intake 18 positioned on the bottom surface 19 of the pool, a water line 20, shown in cut away, extending from the intake 18 to a filter 22 and pump 24. The line 25 extending from the pump, only partially shown, extends to one or more pool filtered water outputs 26. A conventional pool light 28 and a deck access to the pool line 25 is shown. A water motion sensor 30 is shown resting on the pool bottom surface 19. A pair of fibre optic light transmission lines 31 and 32 extend from the sensor 30, through the intake 18 and water line 20 and exiting the water line 20 through a water tight sealed aperture at 33 and extending to the electronic control circuit enclosure 34 located along the wall 12. Also along wall 12 is an opening 36, such as an entry open doorway or the like.

At a first level in the opening 36 is a pair of end to end aligned and spaced apart fibre optic light transmission lines 38 and 40. Both lines 38 and 40 originate or terminate at the electronic circuit enclosure 34. At a second level in the opening is a second pair of end to end aligned and spaced apart fibre optic light transmission lines 42 and 44. Like the above pair, both lines 42 and 44 originate or terminate at the electronic circuit enclosure 34. The pairs of fibre optic light transmission lines 38, 40, 42, and 44 are end to end aligned in such a manner to allow light leaving the end of one of the pair to be received and further transmitted by the other of the pair in the absence of an object therebetween in the doorway.

Figure 2:
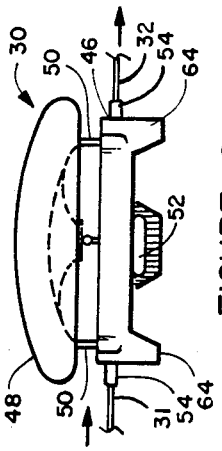
FIG. 2 depicts a side view of the underwater alarm activating sensor of the invention.

Referring now to FIG. 2 which depicts a side view of embodiment of the water motion sensor 30. The sensor comprises a housing 46 and a cover 48 which is attached to the housing 46 by means of studs 50. The cover 48 further functions as a hydroacoustic pressure venturi and ballast. The purpose of which is to amplify and direct the hydrostatic pressure from water impact in a downward motion on the upper most diaphragm 56 as opposed to that pressure merely passing over the top of the diaphragm. The cover 48 will also aid in movement of the diaphragm the required distance of travel with sharp snap type motions rather than merely flowing thereon. and an air cavity 52 which contains a sufficient amount of air to provide zero buoyancy to the sensor. A pair of fibre optic transmission lines such as 31 and 32 are oppositely attached to and pass through the housing 46 by means of snap-in connector 54. The arrows indicate the direction of flow of light transmission.

Figure 3:
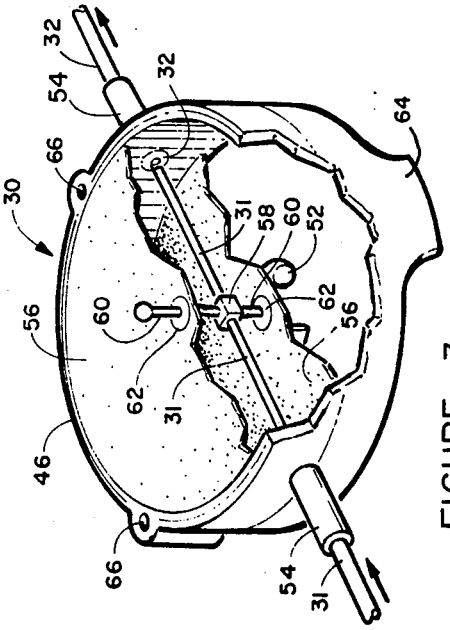
FIG. 3 is a partial cut-away showing of a first embodiment of the underwater alarm activating sensor of the alarm system.

FIG. 3 is a perspective cut-away detail showing of the FIG. 2 sensor. Positioned within the housing 46 are a pair of diaphragms 56 positioned across the top and bottom surface of the housing. The fibre optic transmission line 31 extends across the open chamber of the housing substantially to the opposite wall. Slightly spaced from the opposite wall and from the end of fibre optic transmission line 31 is the end of fibre optic transmission line 32. The two fibre optic transmissions of the Figure are shown with a normally end to end alignment therebetween. This is shown for convenience of explanation and the fibre optic transmission lines 31 and 32 could also be normally in end-to-end misalignment to practice this invention. An adjustment block 58 is carried by the fibre optic transmission line 31 and cooperates with a pair of adjustment screws 60 threadedly engaged into the adjustment block 60 and threadedly engaged with the diaphragm 56 and 62. The adjustment of the screws in opposing rotation adjusts the end to end relationship of the fibre optic transmission lines 31 and 32. Legs or pedestals 64 on the bottom surface of the housing 46 position the diaphragm away from the pool bottom to allow the diaphragm to be freely accessible to the pool water. The studs 50 are of sufficient length to space the cover 48 away from the upper diaphragm to allow free access thereto by the pool water. The apertures 66 in the upper periphery of the casing receive the studs 50.

Figure 4:
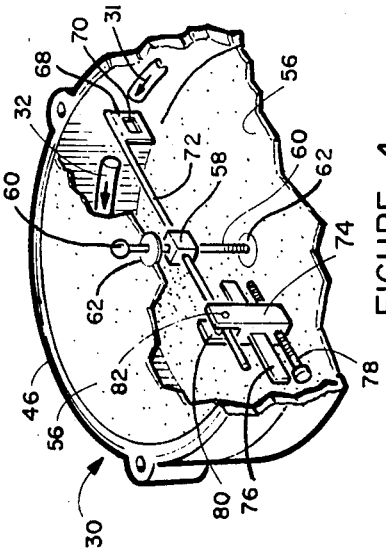
FIG. 4 is a side cut-away showing of a second embodiment of the sensor of the alarm system.

Referring now specifically to FIG. 4, a perspective cut-away showing of a second embodiment of the sensor of the invention is shown. The housing diaphragms etc. of the former embodiment are the same. In this embodiment the fibre optic transmission lines 31 and 32 are mounted within the housing, generally adjacent the inside wall surface as shown, in end-to-end alignment to permit continuous light communication therebetween. Inter posed between the ends of fibre optic transmission lines 31 and 32 is a surface 68 with an aperture or window 70 therethrough. This aperture or window 70 can be normally positioned in line with the ends of fibre optic transmission lines 31 and 32 to allow light transmission therebetween or out of alignment of the ends to normally prevent light transmission between the fibre optic transmission lines. The aperture or window is shown normally in alignment for convenience of explanation which hereinafter follows. The surface 68 is carried by support member 72 which passes through a smooth bore in adjustment block 58. The block 58 is attached to and adjustable relative to the diaphragms in the same manner as hereinbefore discussed. The sensitivity of the movement of support member 12 and surface 68 is determined by the position of adjustment block 74 relative to adjustment block 58. The block 74 can be moved toward and away from the block 58 by means of a track 76 which positionally allows the adjustment block 74 to slide therealong by means of the adjustment screw 78. The track is fixed by attached at its outer end to the housing 46. The upper surface of the adjustment block 74 includes a cut-away portion 80 for receiving the support member 72 therein. A dowel pin 82 passes across the cut-away portion 80 and captures the outer end of the support member 72 between the bottom surface of the cut-away portion 80 and the dowel pin 82 acts as a pivot point for the support member 72 during vertical movement resulting from movement of the diaphragms.

Figure 5:
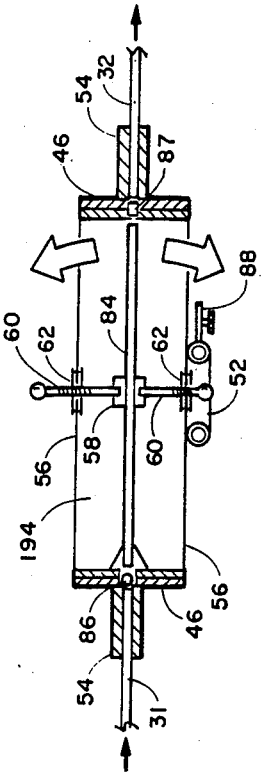
FIG. 5 is a partial cut-away perspective showing of a third embodiment of the underwater alarm activating sensor of the invention.

Referring now specifically to FIG. 5 which is a side cut-away showing of a third embodiment of the sensor 30 of the invention. In this embodiment the optic fibre light transmission lines 31 and 32 terminate at the wall of the housing 46 at opposing surfaces thereof. Attached to and passing through the adjustment block 58 is a fibre optic light transmission section 84. The fibre optic light transmission section 84 is positioned to be on substantially the same plane as the optic fibre transmission lines 31 and 32, that is either aligned for light transmission between between 31 and 32 or misaligned in a manner so that movement of the diaphragms in an expected manner upon water surface impact cause light to be transmitted therebetween. For convenience of discussion, the section 84 will normally be in alignment as shown. A glass bead 86 may be positioned adjacent the distal end of optic fibre transmission line 31 if desired to enhance the light transmission through the section 84. At the distal end of optic fibre transmission line 32 a convex lens 87 may be inserted to amplify the light entering line 31. A Schrodar type valve 88 is shown for the purpose of pressurizing or de-pressurizing air cavity 52.

Figure 6:
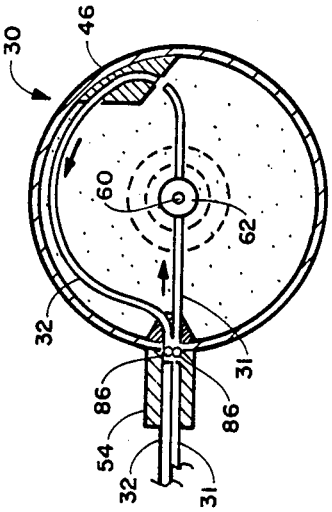
FIG. 6 is a cut-away plan view of a fourth embodiment of the sensor of the invention.

Referring now specifically to FIG. 6 which depicts a plan cut-away showing of a fourth embodiment of the sensor of the invention. In this embodiment, the optic fibre transmission lines 31 and 32 operate in the same manner as hereinbefore discussed under the discussion of FIGS. 2 and 3 except both transmission lines enter and exit through the same connector 54.

Figure 7:
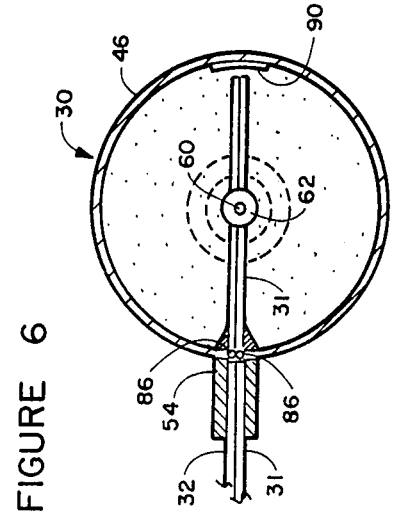
FIG. 7 is a cut-away plan view of a fifth embodiment of the sensor of the invention.

Referring now specifically to FIG. 7 which is a cut-away plan showing of a fifth embodiment of the sensor 30 of the invention. In this embodiment like the forth embodiment, the optic fibre light transmission lines 31 and 32 enter or exit through the same connector 54. The lines 31 and 32 both pass through adjustment block 58 and extend substantially to the opposite wall of the housing 46. Positioned on the opposite wall on the same plane either in alignment or misalignment as hereinbefore discussed is a convex reflective surface 90. The surface of the reflective surface 90 is formed so that when in alignment with the lines 31 and 32 light is transmitted from one line to the reflective surface and reflected back into the other line, such as from 31 through the reflective surface back to line 32. Adjustments for normal alignment or missalignment are performed in the same manner as hereinbefore described.

Figure 8:
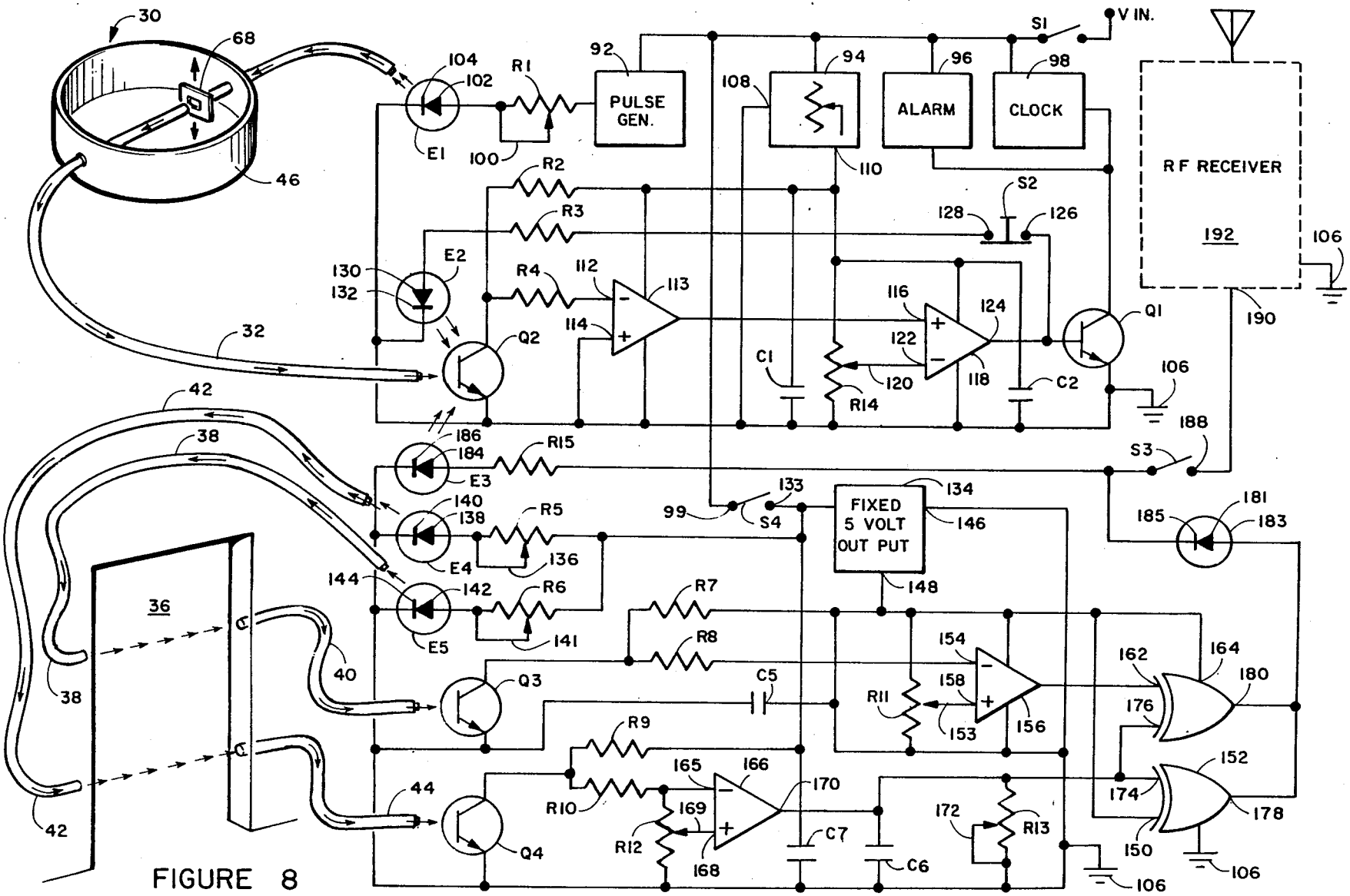
FIG. 8 is the electrical schematic of the electronics of the sensing switching and alarm circuits of the invention.

Referring now specifically to FIG. 8 which depicts the electronic schematic employed in the invention for alarm activation by the sensors hereinbefore or hereinafter described. A sensor 30 is shown which includes optic fibre light transmission lines 31 and 32 connected thereto in the manner hereinafter discussed. Line 31 is positioned to receive the light emitted from light transmitting diode E1 which is an infra red (ir) light emitting diode (LED) of the galluim aluminum arsinide type or light emitting equivalent thereto. The other end of line 32 is positioned to transmit light into the light receiving aperture adjacent the base element of photo transistor Q2. The electronic alarm activating circuit related thereto is hereinafter described in specific detail.

Operating voltage VIN is supplied to the circuit of FIG. 8 through switch 51 of the single pole, double through (SPDT) type. Input voltage VIN is connected to a pulse generator 92, voltage regulator 94, an alarm 96, a clock 98 and to terminal 99 of switch S4. The output of the pulse generator 92 is connected to one end of potentiometer R1 of 1K ohms. The opposite end of the potentiometer R1 is connected to its wiper 100 and to the anode 102 of LED E1. The cathode 104 of anode 102 is connected to common ground 109.

Terminal 108 of the regulated power supply 94 is connected to common ground. The regulated voltage output terminal 110 is connected to one end of resistor R2 of 10 meg ohms. The other end of resistor R2 is connected to one end of resistor R4 of 10 meg ohms and the collector element of phototransistor Q2. The emitter element of photo transistor Q2 is connected to common ground 106. The opposite end of resistor R4 is connected to the inverting−input terminal 112 of an operational amplifier 113 of the LF353N type or equivalent thereto. The non-inverting+input terminal 114 is connected to common ground through a capacitor C1 of 0.01 micro farad; to one end of potentiometer resistor R14; to common ground through capacitor C2 of 0.001 micro fared; and to various operational amplifiers hereinbefore and hereinafter discussed.

The output of operational amplifier 113 is connected to the+input terminal 116 of operational amplifier 118. The wiper 120 of potentiometer resistor R14 is connected to the in inverting−input terminal 122 of the last mentioned operational amplifier. The opposite end of resistor R14 is connected to common ground. The output terminal 124 of operational amplifier 118 is connected to the base element of transistor Q1 and to terminal 126 of switch 52 of the "press to open" and "release to close" type. Terminal 128 of switch 52 is connected to one end of resistor R3 of 470 ohms. The opposite end of R3 is connected to the anode 130 of LED E2. The cathode 132 of LED E2 is connected to common ground. The light emitted from LED E2 is directed toward the base of photo transistor Q2.

The collector of transistor Q1 is connected to ground connection 136 of alarm 96 and clock 98. The emitter of transistor Q1 is connected to common ground 106.

Referring now to the lower portion of FIG. 8 and specifically to doorway monitor system interconnected to terminal 132 of switch 54.

The doorway 36 has pairs of spaced apart aligned fibre optic light transmission lines at different elevations. Line 38 which receives light from LED E5 and transmits this light across the unobstructed door opening to line 40 which directs the light from LED E5 to the base element of photo transistor Q3. Likewise line 42 receives light from LED E4 and transmits that light to line 44 which directs that light toward the base element of photo transistor Q4. In some instances due to doorway width or intensity or type of light source concentrating lens may be required at the distal ends of transmission lines 38 and 42.

The circuit connections are as follows. Terminal 133 of switch S4 of the ST DP type is connected to a 5 volt DC regulated power supply 134, to one end of resistor R5 of 1K ohms, resistor R6 of 1K ohms, to common ground 106 through capacitor C7 of 0.001 micro farads, to one end of resistor R9 of 10 meg ohms, and to one end of potentiometer resistor R12 of 20K ohms. The opposite end of R5 is connected to its wiper 136 and anode 138 of LED E4. The cathode 140 of LED E4 is connected to common ground. Likewise, the other end of R6 is connected to its wiper 141 and anode 142 of LED E5. The cathode 14.4 is connected to common ground.

Terminal 146 of the regulated power supply 134 is connected to common ground. Output terminal 148 is connected to one end of resistor R7 of 10 meg ohms, to common ground through capacitor C5 of 0.01 micro farads to input terminal 150 of exclusive OR gate 152 and to one end of potentiometer resistor R11 of 20K ohms. The opposite end of resistor R7 is connected to one end of resistor R8 of 100K ohms and the collector element of photo transistor Q3. The emitter element of photo transistor Q3 is connected to common ground. The opposite end of resistor R8 is connected to the input terminal 154 of operational amplifier 156. The opposite end of R11 is connected to commonground. The wiper 153 of R11 is connected to the + input terminal 158 of operational amplifier 156. The output terminal 160 of operational amplifier 156 is connected to terminal 162 of exclusive OR gate 164.

The opposite end of resistor R9 is connected to one end of resistor R10 and the collector element of photo transistor Q4. The emitter element of Q4 is connected to common ground 106.

The opposite end of resistor R12 is connected to common ground 106. The other end of R10 is connected to the inverting − input terminal 165 of operational amplifier 166. The non-inverting + terminal 168 of operational amplifier 166 is connected to the wiper 169 of resistor R12. The output terminal 170 of amplifier 166 is connected to common ground through capacitor C6 of 100 micro farad and potentiometer R13 of 1K ohms. The opposite end of R13 is connected to common ground as is its wiper 172. Output terminal 170 of operational amplifier 166 is also connected to input terminal 174 of OR gate 152 and terminal 176 of OR gate 164. The output terminals 178 and 180 respectively of OR gates 152 and 164 are connected to the anode 181 of diode 183. Cathode 185 of diode 181 is connected to terminal 182 of switch S3. The same terminal 182 is connected to one end of resistor R15 of 470 ohms. The opposite end of resistor R15 is connected to the anode 184 of LED E3. The cathode 186 of LED E3 is connected to common ground 106. The light emitted from LED E3 is directed toward the base of photo transistor Q2. The terminal 188 of switch S3 is connected to the power output terminal 190 of an RF receiver 192 hereinafter discussed in detail.

OPERATION

The circuit associated with the optic fibre transmission line operates as follows. When energized by closing S1 and applying Vin (of approximately +9V D.C.) to the circuit LED E1 conducts according to the frequency of pulse generator 92 or steady state if the pulse generator is omitted. It should therefore be understood that the circuit operates equally or well with pulse generator 92 omitted with the voltage Vin directly applied to anode 102. The pulse generator is employed for the purpose of conserving energy from source Vin. The light from LED E1 is transmitted through line 31 to the sensor 30. The sensor 30, employing one of the embodiments hereinbefore described in detail, is adjusted to normally not allow light to pass into optic fibre light transmission line 32 which is directed to the base of photo transistor Q2. In this mode, alarm 96 and clock 98 will be inactive because the switch action of transistor Q1 will be open, i.e. there will be no conduction of transistor Q1 and hence no common ground which is required to activate the alarm and clock. When the diaphragms 56 of the sensor are caused to move due to a surface impact by an object striking the pool water surface the light from LED E1 will be directed the base of photo transistor Q2. In the presence of light thereon, transistor Q1 will conduct placing the ground connection required to activate the alarm and timer. A momentary activation of S2 will terminate the operation of the alarm and clock, i.e. transistor Q2 will not conduct due to the non-illumination of LED E2. LED E2 acts as a latch "on" for the system. It should be understood that the device will also be operable with the light from LED E1 normally not present at the base of photo transistor Q2 and light present on the base of transistor Q1 caused by diaphragm movement will activate the alarm and clock in a similar manner. When the normally present light mode is desired the inputs 112 and 114 to operational amplifier 113 must be reversed.

Referring now to the pool access portion of the pool alarm system. When switch S4 is closed Vin is applied to LEDS E4 and E5. The light from the LEDS is transmitted via optic fibre light transmission lines 42 and 38 respectively to their selected door opening elevation. The light at the door opening end of lines 38 and 42 is directed across the opening and are received by the door opening ends respectively of optic fibre light transmission lines 40 and 44. The light from the opposite ends of these lines are directed toward the base elements of photo transistors Q3 and Q4 as aforementioned.

Figure 9:
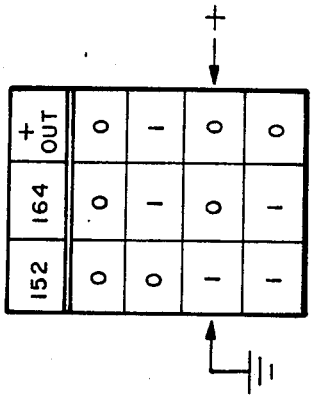
FIG. 9 is a truth table representative of the entry sensing circuits of FIG. 8.

Referring now to FIG. 9 which is the gate truth table which references to the output state of OR gates 152 and 164. If the light source across the doorway for both gates is undisturbed than there is no output from the gates hence LED E3 does not illuminate and the alarm 96 and clock 98 are not activated. When the light between lines 42 and 44 is interrupted, an output from OR gate 164 is present and, hence, LED 184 illuminates sounding the alarm and starting the clock. When the light between lines 38 and 36 is disturbed and the light between lines 42 and 44 is undisturbed, no alarm or clock action results, i.e. LED E3 does not illuminate. The same result occurs when light transmission between both 38 and 40 and 42 and 44 is interrupted.

When the door opening alarm sensor is employed with the pool impact alarm sensor, the pool impact alarm sensor must be wired as shown, that is, terminals 112 and 114 of operational amplifier 113 must be connected as shown.

The alarm 96 can take many different forms, such as for example audio signaling devices, optical signaling devices, lights, etc. singularly or in combination.

The optic fibre for the various light transmission liner is well known in the physical light transmitting art. Bundles of this optic fibre, as well as thick single fibers may be employed to practice the invention.

The space or reservoirs 194 (see FIG. 5) between the diaphragms 56 is generally filled with distilled water or water soluble oil with a minimum of trapped air.

Figure 10:
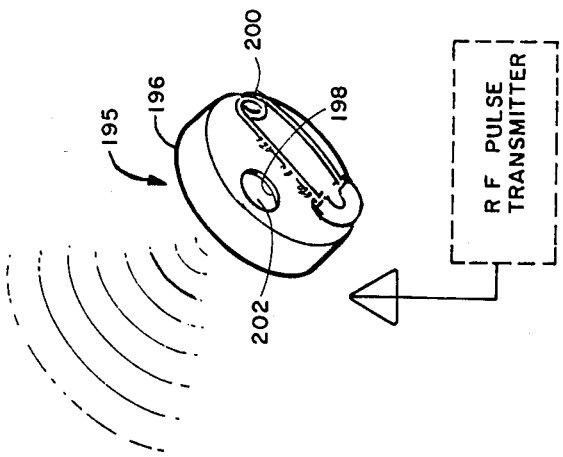
FIG. 10 is a user attached sensor.

Referring now specifically to FIG. 10 which depicts a water sensing element 195 which includes an RF transmitter operating on the same frequency as RF receiver 192 hereinbefore mentioned. The transmitter 195 includes a housing 196 with an aperture 198 located through one surface thereof and a pin 200 for attachment of the sensor to an object such as a person or an animal. Within the sensor behind the aperture 198 is a diaphragm switch 202 which deactivates the pulse transmitter 192 (not shown) the signal from which is received by receiver 192.

When S3 is closed and receiver stops receives RF pulse signals from transmitter 202, LED E3 illuminates and activates the alarm and clock. The alarm system is reset in the same manner as hereinbefore described. When the man-overboard transmitter and receiver embodiment is employed operational amplifier must be wired as shown for reasons hereinbefore mentioned.

The operational amplifier and OR gates are wired between supply voltage (Vin) and common ground in their perspective manner, for example as shown in FIG. 8. OR gates 152 and 164 are shown as a pair of Ex-OR gates contained in a single housing.

Although various preferred embodiments of the invention have been described herein in detail it will be appreciated by those skilled in the art that variations may be made thereto without departing from the spirit of the invention or the scope of the appended claims.

The embodiment of the invention in which exclusive property or privilege is claimed is claimed as follows:

1. An alarm system for detecting persons having a height less then a pre-determined height passing through an opening comprising.

first and second light sources;

first, second, third and forth optic transmission means;

switching means;

logic means; and alarm means, said first light source is transmitted through said first optic transmission means to a first elevation in said opening, said second optic transmission means receives said first light source from said first optic transmission means across said opening and transmits said first light source to said logic means, said second light source is transmitted through said third optic transmission means to a second elevation in said opening lower in height then said first elevation, said fourth optic transmission means receives said second light source from said third optic transmission means across said opening and transmits said second light source to said logic means, said logic means operates said switching means which activates said alarm only when only the second light source across said opening is interrupted.

2. The invention as defined in claim 1, wherein said optic transmission means is constructed of optic fiber material.

3. The invention as defined in claim 1, wherein said logic means comprises two exclusive OR gates.

* * * * *